US007971645B2

(12) United States Patent
Verma

(10) Patent No.: US 7,971,645 B2
(45) Date of Patent: Jul. 5, 2011

(54) FOUR MILL BOTTOM HOLE ASSEMBLY

(75) Inventor: Suhas S. Verma, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 244 days.

(21) Appl. No.: 12/384,381

(22) Filed: Apr. 3, 2009

(65) Prior Publication Data

US 2010/0252265 A1 Oct. 7, 2010

(51) Int. Cl.
*E21B 7/08* (2006.01)
*E21B 10/26* (2006.01)
*E21B 29/06* (2006.01)

(52) U.S. Cl. ..... 166/298; 166/55.7; 175/61; 175/391

(58) Field of Classification Search ..... 166/298, 166/55.7; 175/61, 79, 391
See application file for complete search history.

(56) References Cited

U.S. PATENT DOCUMENTS

| | | | | |
|---|---|---|---|---|
| RE33,751 | E * | 11/1991 | Geczy et al. | 175/61 |
| 5,109,924 | A | 5/1992 | Jurgens et al. | |
| 5,445,222 | A * | 8/1995 | Pritchard et al. | 116/298 |
| 5,647,436 | A | 7/1997 | Braddick | |
| 5,657,820 | A * | 8/1997 | Bailey et al. | 166/55.7 |
| 5,730,221 | A * | 3/1998 | Longbottom et al. | 166/298 |
| 5,806,600 | A | 9/1998 | Halford, Sr. | |
| 5,887,655 | A | 3/1999 | Haugen et al. | |
| 5,899,268 | A | 5/1999 | Lynde et al. | |
| 5,988,272 | A * | 11/1999 | Bruce | 166/55.6 |
| 6,155,349 | A * | 12/2000 | Robertson et al. | 166/298 |
| 6,202,752 | B1 * | 3/2001 | Kuck et al. | 166/298 |
| 6,209,645 | B1 | 4/2001 | Ohmer | |
| 6,302,198 | B1 | 10/2001 | Ritorto et al. | |
| 6,454,007 | B1 | 9/2002 | Bailey | |
| 6,488,090 | B1 | 12/2002 | Ohmer | |

(Continued)

FOREIGN PATENT DOCUMENTS

CA 2414432 12/2002

(Continued)

OTHER PUBLICATIONS

M.S. Aston, et al., Techniques for Solving Torque and Drag Problems in Today's Drilling Environment, Sep. 27-30, 1998, pp. 55-68, SPE 48939, Society of Petroleum Engineers, Inc., U.S.A.

(Continued)

*Primary Examiner* — Kenneth Thompson
(74) *Attorney, Agent, or Firm* — Greenberg Traurig LLP; Anthony F. Matheny

(57) ABSTRACT

Bottom hole assemblies for cutting windows in wellbore casing comprise a window mill, a first upper mill, a second upper mill, and a third upper mill. The first mill has an outer diameter that is smaller than the outer diameters of the window mill and the second and third upper mills. The first upper mill is disposed above the window mill at a distance measuring approximately twenty to thirty-seven percent of the distance measured from the window mill to the third upper mill. The second upper mill is disposed above the window mill at a distance measuring approximately fifty-five to seventy-five percent of the distance measured from the window mill to the third upper mill. The third upper mill is disposed above the window mill at a distance measuring approximately one-hundred twenty to one-hundred thirty percent of the length of a ramp of a whipstock for guiding the mills.

16 Claims, 5 Drawing Sheets

U.S. PATENT DOCUMENTS

| | | | | |
|---|---|---|---|---|
| 6,520,255 | B2 | 2/2003 | Tolman et al. | |
| 6,668,945 | B2 * | 12/2003 | Ohmer | 175/61 |
| 6,715,567 | B2 | 4/2004 | Delgado et al. | |
| 2002/0070018 | A1 | 6/2002 | Buyaert | |
| 2007/0181305 | A1 | 8/2007 | McGavern | |

FOREIGN PATENT DOCUMENTS

| | | | |
|---|---|---|---|
| EP | 0701045 | A2 | 3/1996 |
| EP | 1626159 | A2 | 2/2006 |
| WO | WO 97/12112 | | 4/1997 |

OTHER PUBLICATIONS

G.R.J. Mackenzie, et al., Coiled-Tubing-Deployed Re-Entry Whipstocks—Technology Overview and Case Histories, Aug. 31-Sep. 2, 2006, pp. 1-4, SPE 103645, Society of Petroleum Engineers, U.S.A.

N. Robertson, et al., Effective Torque Management of Wytch Farm Extended-Reach Sidetrack Wells, Oct. 9-12, 2005, pp. 1-12, SPE 95430, Society of Petroleum Engineers, U.S.A.

Ernest C. Bailey, et al., World's First Application of "Self-Locating" Technology for Re-Entry of Milled Casing Windows, May 15-16, 2001, pp. 1-9, SPE 70008, Society of Petroleum Engineers, Inc., U.S.A.

R. Madarapu, et al., Coiled-Tubing Gyro MWD Improves Kickoff Direction Accuracy for Cased-Hole Re-Entry Drilling, Mar. 20-21, 2007, pp. 1-6, SPE 106405, Society of Petroleum Engineers, U.S.A.

Austin Freeman, et al., First Successful Multilateral Well Installation From a Floating Rig: Development and Case History, Mar. 3-6, 1998, pp. 647-658, IADC/SPE 39369, IADC/SPE Drilling Conference, U.S.A.

* cited by examiner

FOUR MILL BOTTOM HOLE ASSEMBLY

BACKGROUND

1. Field of Invention

The invention is directed to devices for milling a window in casing disposed in an oil or gas wellbore and, in particular, to four-mill bottom hole assemblies for cutting a window in the wellbore casing such as for allowing a lateral, offshoot, horizontal, or branch wellbore to be drilled.

2. Description of Art

Bottom hole assemblies, or casing window milling assemblies, for use with whipstocks disposed within wellbore casing are known in the art. In general, these assemblies operate by lowering the assembly into a wellbore casing until a cutting end, or mill head or window mill, contacts the whipstock. As the assembly is further lowered, the window mill is forced into the wellbore casing by the whipstock. As a result, the window mill begins cutting the wellbore casing to form a window.

Contemporaneously, two additional, or secondary, mills such as a reaming mill and a honing mill, begin cutting the wellbore casing above the window formed by the window mill. As the window mill moves further downhole, and is further forced into the wellbore casing by the whipstock, the opening in the casing, or window, is enlarged, usually by the two secondary mills cutting additional openings in the casing above the whipstock and gradually moving toward the window formed by the window mill until the openings and the window connect. To assist with the bending moment caused by the window mill being forced by the whipstock into the wellbore casing, a flex-joint or flexible section within the upper mills is usually disposed above the window mill.

Although prior assemblies are effective at ultimately forming the desired opening in the wellbore casing, they have several shortcomings. For example, the size of the window ultimately cut in the casing should, theoretically, be as long as the ramp of the whipstock. The length of the ramp of the whipstock is defined as the distance along the angled portion of the whipstock from the point where the window mill is first moved toward the casing wall to the bottom of the angled portion. However, the window formed by the typical three-mill bottom hole assemblies have difficulty cutting a window that is as long as the ramp length of the whipstock because of the loss of appreciable restraining force on the window mill during its traverse on the bottom quarter section of the whipstock ramp. As a result, the length of the window is shortened such that longer and larger diameter assemblies and other equipment which, in most cases, are more desirable, cannot pass through the opening.

Current casing window milling assemblies also experience problems with the cutting structure on the mills wearing out prematurely while cutting a window in large size casings with large size whipstocks. In many instances, three mills in three-mill assemblies do not ensure enough cutting structure to create a full gauge window while sustaining the long ramp lengths of large size whipstocks. The vibration impact can also cause the cutters to breakdown and the mills loose their cutting ability prematurely. This can lead to the considerable expense of a second milling operation with a fresh set of mills.

Also, in many situations, disposition of a full gauge secondary reaming/honing mill at a location too close to a full gauge window mill produces large bending stresses in the bottom hole assembly, especially between the window mill and the secondary mill.

SUMMARY OF INVENTION

Broadly, the bottom hole assemblies or casing window milling assemblies disclosed herein comprise four separate mills disposed at particular locations along the length of the bottom hole assembly. The locations of each of the mills allow for a window to be cut in the casing that is substantially equal to or greater than the length of the ramp of the whipstock. "Substantially equal to" is used herein as meaning at least 95% of the length of the ramp of the whipstock.

The bottom hole assemblies comprise a window mill at a lower end of the bottom hole assembly. In some embodiments, the window mill is releasably connected to a whipstock so that the whipstock and the bottom hole assembly are run into the wellbore together. A first upper mill is disposed above the window mill, a second upper mill is disposed above the first upper mill, and a third upper mill is disposed above the second upper mill. The first upper mill is an under-gauged mill disposed at a distance measuring approximately 20-37% of the distance measured from the window mill to the third upper mill. In one particular embodiment, the first upper mill is at a distance that is 25% of the distance measured from the window mill to the third upper mill.

The second upper mill is disposed above the first upper mill and, thus, the window mill, at a distance measuring approximately 55% to 75% percent, and in one embodiment 65% percent, of the distance measured from the window mill to the third upper mill. The third upper mill is disposed above the second upper mill and, thus, the first upper mill and the window mill, at a distance measuring approximately 120% to 130%, and in one embodiment, 125% of the length of the ramp of the whipstock.

BRIEF DESCRIPTION OF DRAWINGS

FIG. 1 is a cross-sectional view of one specific embodiment of a casing window milling assembly disclosed herein and a whipstock shown disposed in a cased wellbore during run-in.

Figure 1:
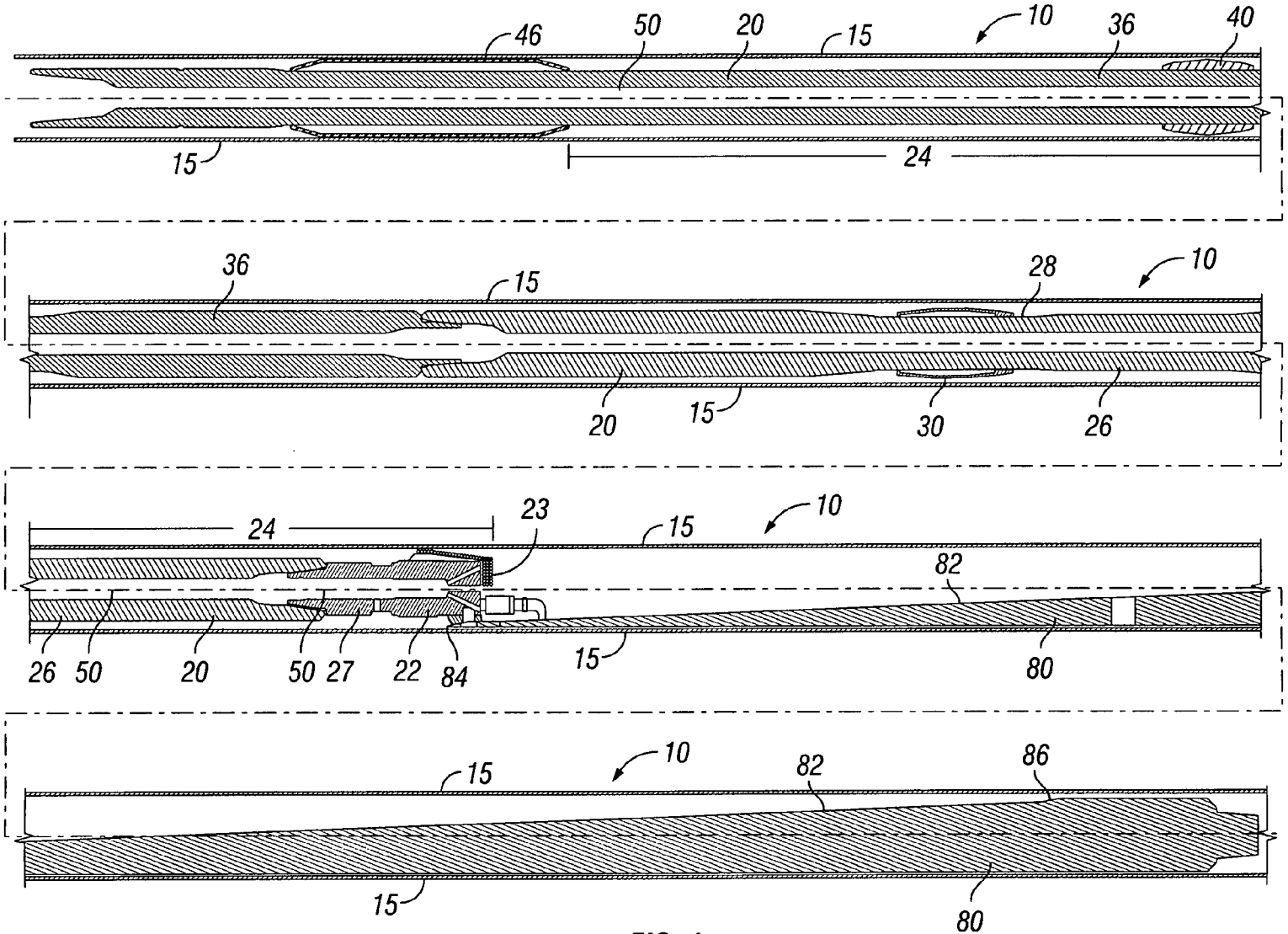

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Referring now to FIGS. 1-5, in one specific embodiment, casing window milling assembly of bottom hole assembly 20 includes window mill 22 secured, such as through threads (not shown), to lower joint 26. Window mill 22 may be a conventional carbide mill or PDC mill known in the art. Lower joint 26 may be a rigid joint or have flexibility to assist in reducing stresses in bottom hole assembly 20. Window mill 22 includes lower end 23 and mill head housing or body 27. Lower joint includes under-gauged portion 28 to which first upper mill 30 is secured, or which forms first upper mill 30. As is readily understood by persons of ordinary skill in the art, first upper mill 30, as well as any other mills discussed herein, may be separate components secured to the joints of bottom hole assembly 20 or they may be formed integral with the joints of bottom hole assembly 20.

Under-gauged portion 28 is used herein to describe a portion of the lower joint 26 that has an outer diameter that is smaller than the outer diameter of the remainder of lower joint 26. In alternative embodiments, the outer diameter of lower joint 26 is uniform, i.e., there is no under-gauged portion 28, or the portion of lower joint 26 that includes mill 30 has an enlarged outer diameter to provide additional strength to lower joint 26. In these embodiments, first upper mill 30 disposed along lower joint 26 is a mill that has an outer diameter that is smaller than the maximum outer diameter of window mill 22 and the maximum outer diameters of the mills disposed above first upper mill 30, which are discussed in greater detail below. Regardless of whether lower joint 26 includes an under-gauged portion 28 or if the lower joint includes an under-gauged mill, first upper mill 30 is referred herein as the "under-gauge mill" because the combined outer diameter, i.e. the outer diameter of lower joint 26 and the overall thickness of first upper mill 30, is less than the maximum outer diameters of window mill 22 and the two mills disposed above first upper mill 30. First upper mill 30 is disposed along lower joint 26 above window mill 22 at a distance measuring approximately 20% to 37%, and in one embodiment 25%, of the distance 24 measured from window mill 22 to third upper mill 46 (discussed in greater detail below).

Lower joint 26 is secured, such as through threads (not shown), to upper joint 36. Upper joint is then secured to a tool string (not shown) such as through threads (not shown). Upper joint 36 includes second upper mill 40 and third upper mill 46. In one embodiment, both second upper mill 40 and third upper mill 46 are "full-gauge mills" because their diameters are not increased or decreased by the outer diameter of upper joint 36. Nor are the outer diameters of second upper mill 40 or third upper mill 46 increased or decreased to be any larger or smaller than the maximum diameter of window mill 22.

Second upper mill 40 is disposed toward a lower end of upper joint 36 and third upper mill 46 is disposed toward an upper end of upper joint 36. Second upper mill 40 is disposed above first upper mill 30 and, thus, window mill 22, at a distance measuring approximately 55%-75% percent, and in one embodiment 65%, of the distance 24 measured from window mill 22 to third upper mill 46. Third upper mill 46 is disposed above second upper mill 40 and, thus, above first upper mill 30 and window mill 22, at a distance measuring approximately 120%-130%, and in one embodiment, 125%, of the length of the ramp 82 of whipstock 80. Referring to FIG. 1, the length of ramp 82 is measured from the top 84 of whipstock 80 where ramp 82 begins to the bottom 86 of ramp 82 of whipstock 80. In certain embodiments, whipstock 80 has an over-all length greater than 20 feet and a ramp length greater than 18.5 feet.

The locations of first upper mill 30, second upper mill 40, and third upper mill 46 with respect to window mill 22 facilitates creation of a restraining force on window mill 22 to decrease the chance of early jump-off of window mill 22 from casing 15 near the mid-section of whipstock ramp 82. Also, under-gauge portion 28 disposed at a distance discussed above, facilitates reduction of unacceptable bending stresses in bottom hole assembly 20.

Although first, second, and third upper mills 30, 40, and 46 may be any mills known in the art, in one particular embodiment, first and second upper mills 30, 40 are ball mills having a rounded, arcuate cross-section, and third upper mill 46 is a watermelon mill, having a substantially flat surface cross-section with bearing structure ingrained.

Window mill 22, and first, second, and third upper mills 30, 40, 46, all may include an outer layer of, or formed completely out of, a material selected from the group consisting of carbide, aluminum bronze, tungsten carbide, or hardfacing. Alternatively, or in addition, one or more of window mill 22, or first, second, or third upper mills 30, 40, 46 may include blades or other cutting devices known in the art.

Bore 50 is longitudinally disposed through window head 22, lower joint 26 and upper joint 36 to facilitate circulation of fluid down wellbore 10.

In operation, bottom hole assembly 20 is assembled as shown in FIG. 1, secured to a tool string (not shown), and lowered into wellbore 10 having casing 15. It is to be understood, however, that although whipstock 80 is shown as part of bottom hole assembly 20 in the embodiments of FIGS. 1-5 so that whipstock 80 can be set during a single run of bottom hole assembly 20 into cased wellbore 10, whipstock 80 is not required to be part of bottom hole assembly 20. To the contrary, whipstock 80 may be previously disposed within cased wellbore 10 so that bottom hole assembly 20 can be lowered into cased wellbore 10 until mill head 22 contacts whipstock 80.

Figure 2:
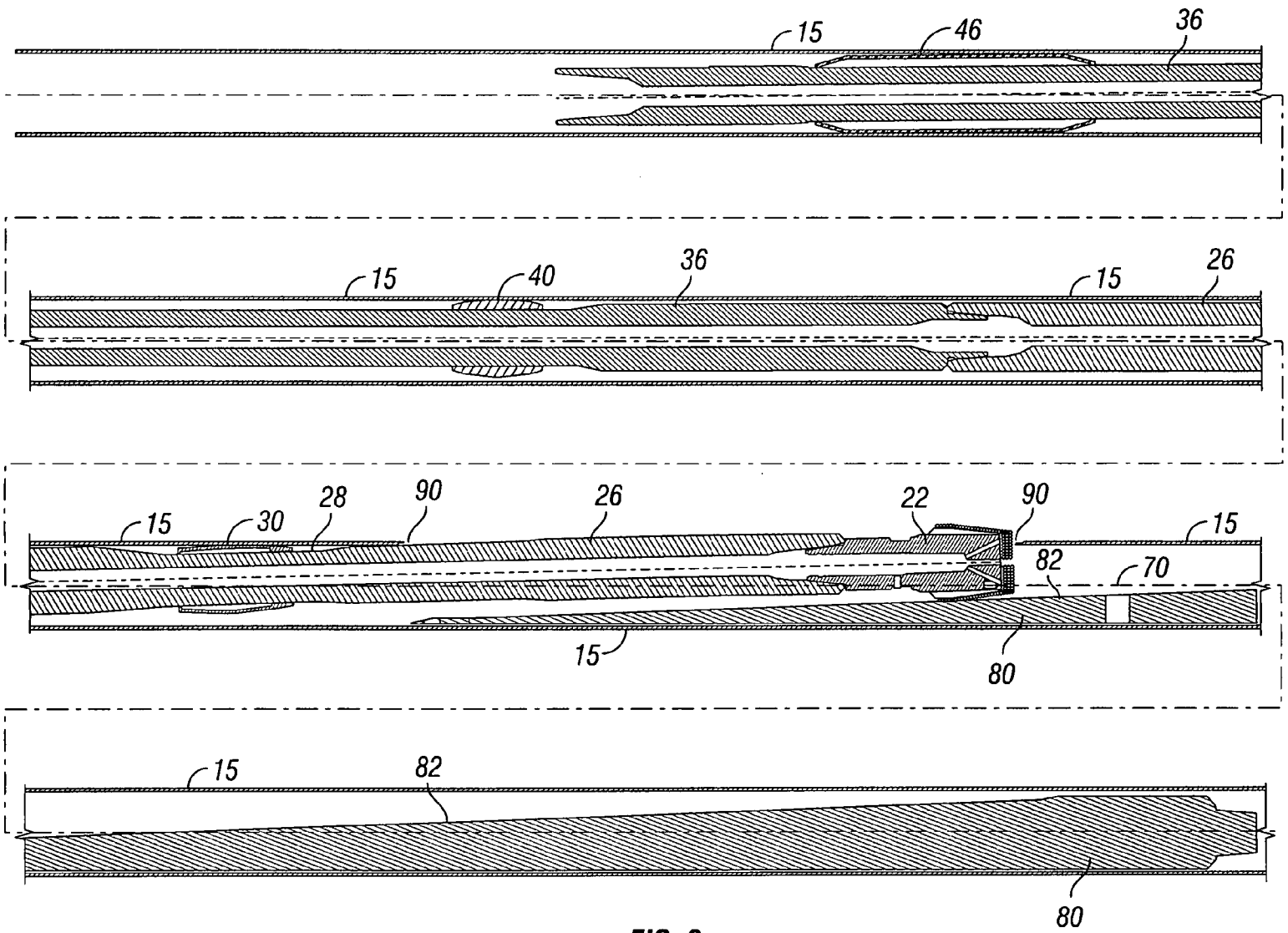
FIGS. 2-5 are cross-sectional views of the assembly shown in FIG. 1 showing the progression of the assembly shown in FIG. 1 as a window is cut in the casing of the wellbore.
Figure 3:
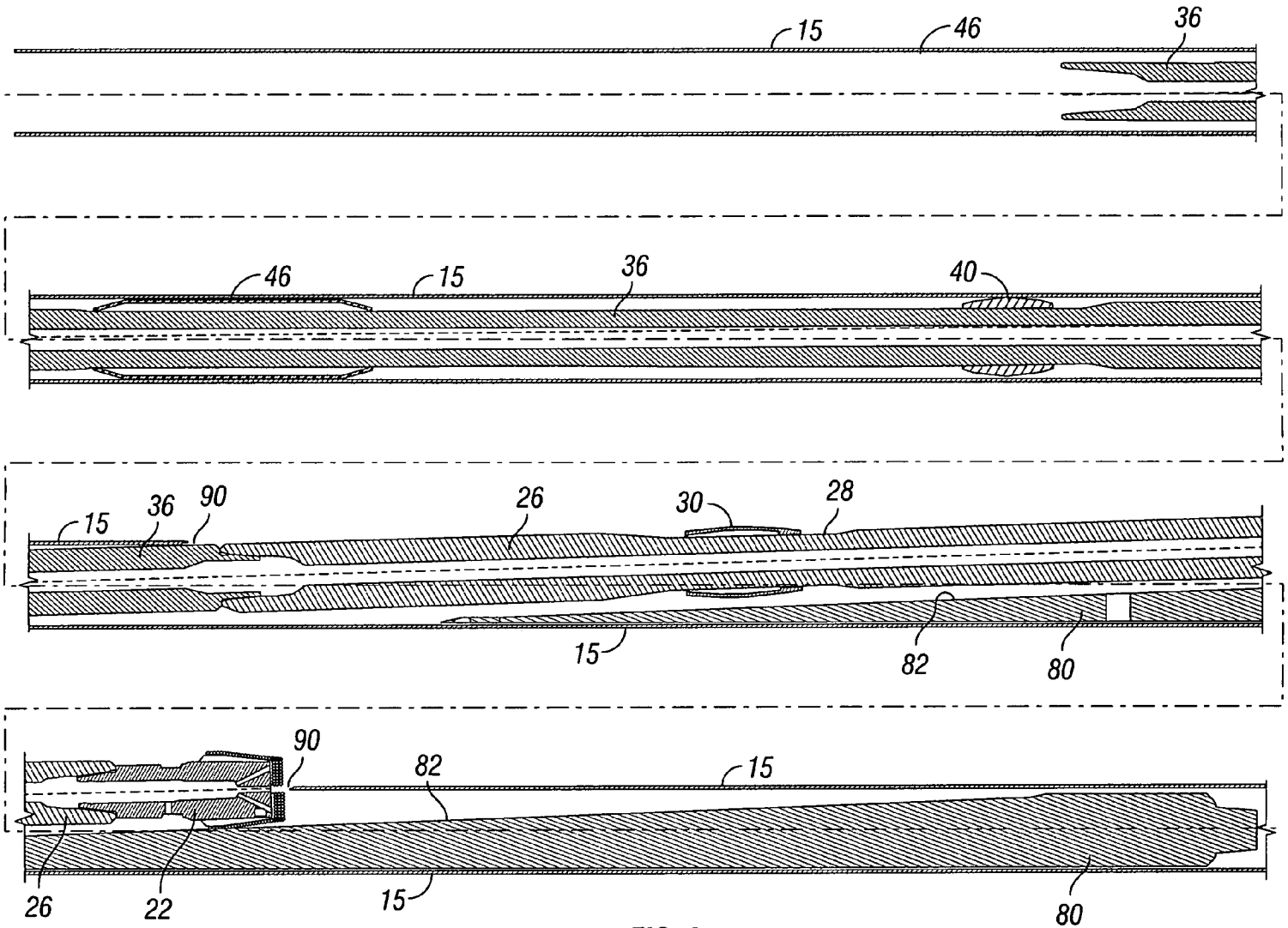
Figure 4:
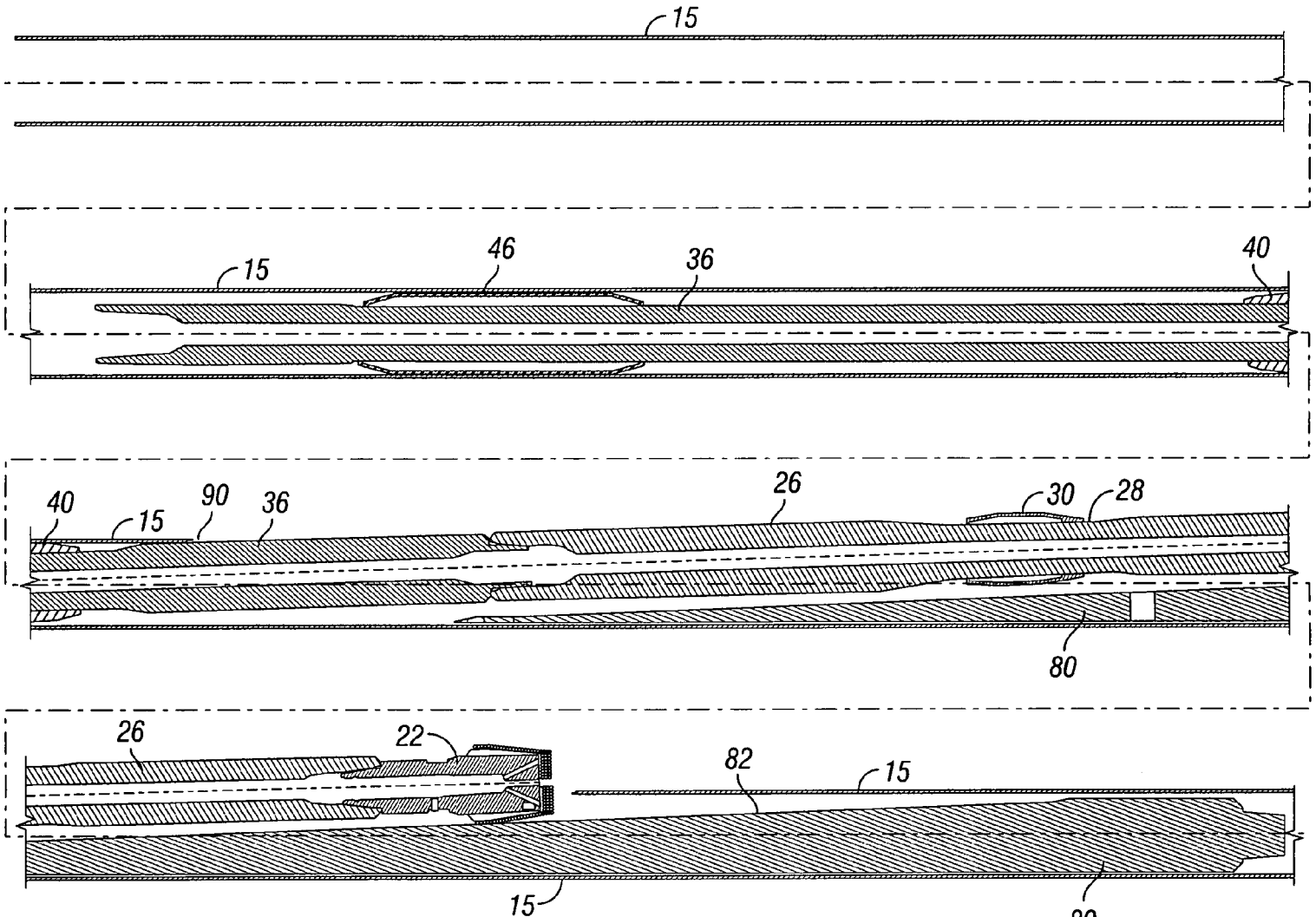
Figure 5:
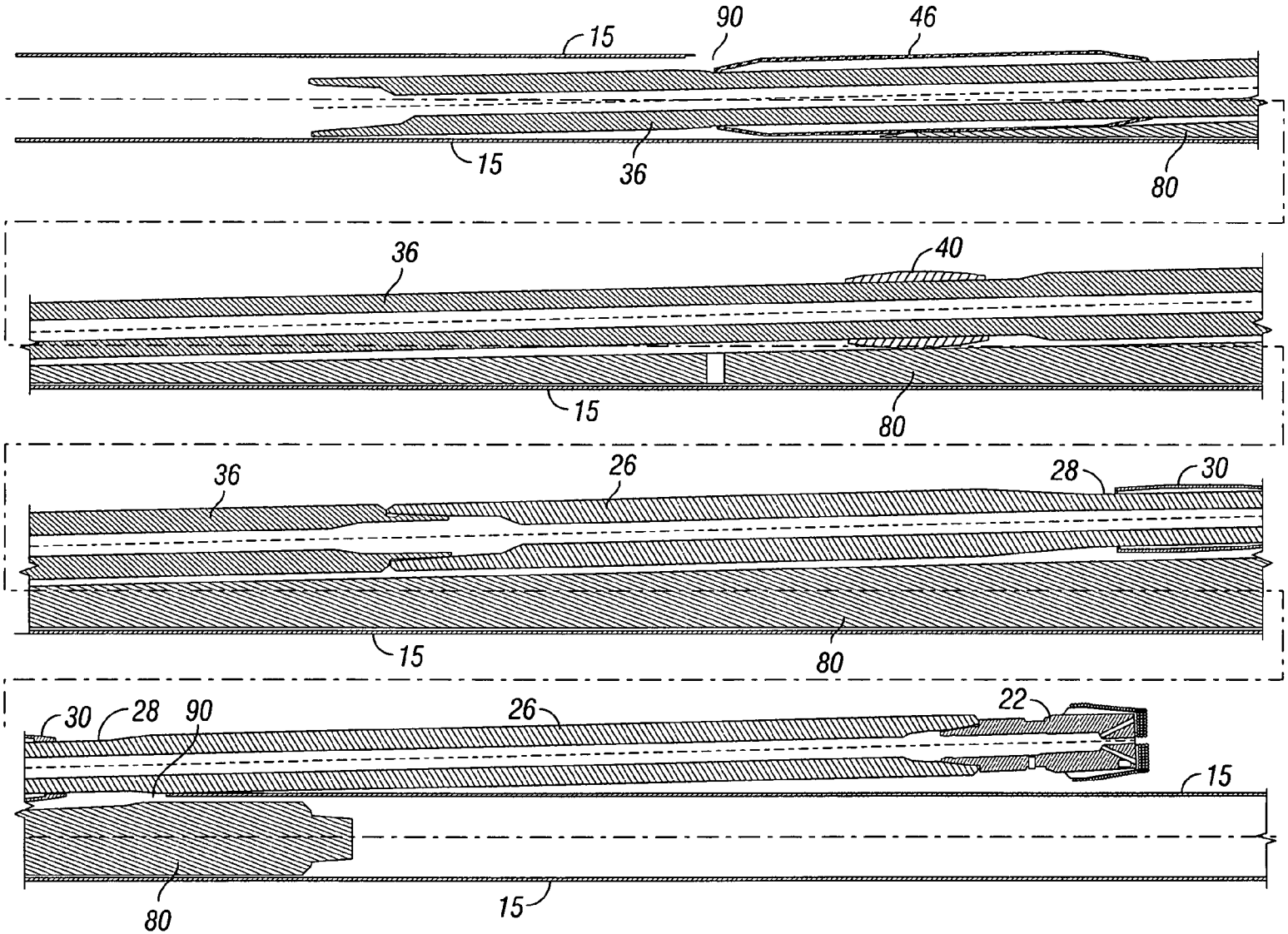

In either of the foregoing operations, window mill 22 is freed from whipstock 80 so that whipstock 80 guides window mill 22 into the wellbore casing 15 to facilitate window mill 22 cutting window 90 in the wellbore casing 15. As bottom hole assembly 20 is lowered downward, bottom hole assembly 20 is rotated and begins cutting window 90 in casing 15 (FIG. 2). As bottom hole assembly 20 is lowered further into casing 15, rotation of bottom hole assembly 20 continues, and cutting of window 90 continues as window mill 22 moves down ramp 82 of whipstock 80 (FIGS. 3-5). In so doing, bottom hole assembly 20 is angled off of the axis 70 (FIG. 2) of casing 15 so window mill 22 cuts through casing 15 and moves into the earth formation (not shown) to form an open-hole wellbore (not shown).

After window mill 22 has cut into casing 15 a sufficient distance, first upper mill 30 engages casing 15 (FIG. 3) above the top of whipstock, and, thereafter, starts to cut casing 15 above window 90. First upper mill 30 continues to cut casing 15 above the top 84 of whipstock 80, and hence enlarging the window 90, until the enlarged portion of window 90, i.e. the portion of casing 15 cut by first upper mill 30, combines with the portion of window 90 cut in casing 15 by window mill 22. Bottom hole assembly 20 then exits casing 15 through window 90 as illustrated in FIG. 5.

During creation of window 90, one or both of second upper mill 40 and/or third upper mill 46 contact casing 15 when window mill 22 is past half-way down the length of ramp 82 of whipstock 80. At this point during the window cutting process, second upper mill 40 and third upper mill 46 contact casing 15 and begin to ream, i.e., clean and cut, the portion of window 90 cut by first upper mill 30. As bottom hole assembly 20 moves downward, second upper mill 40 and third upper mill 46 continue to ream the portion of window 90 cut by window mill 22. It is to be understood, however, that second upper mill 40 and third upper mill 46 are not required to be limited to reaming window 90 in casing 15. In certain embodiments, second upper mill 40 and third upper mill 46 can also engage and cut casing 15 above the portion of window 90 cut by first upper mill 30.

Further down the cutting process, first upper mill 30, second upper mill 40 and third upper mill 46, engage the formation to continue cutting and cleaning out window 90. Because of the location of first upper mill 30 relative to window mill 22, the cutting ability of first upper mill 30 is best utilized to extend window 90 above the top 84 of whipstock 80 and ream/clean window 90 at later stages of window formation. As also shown in FIG. 5, window 90 is greater than length of ramp 82 of whipstock 80. After this is accomplished bottom hole assembly 20 can be retrieved from the wellbore casing 15 and a drill string or another piece of equipment can be run into the wellbore casing 15 to complete the new wellbore.

The four mills of bottom hole assembly 20 disposed at the locations discussed herein assist in providing a constant and appreciable restraining force on window mill 22 during its traverse on the bottom quarter section of whipstock ramp 82 leading to a longer window length, especially with large size whipstocks. The location of first upper mill 30 to window mill 22 also facilitates creation of a restraining force on window mill 22 to reduce the chance of early jump-off of window mill 22 from casing 15. Under gauge first upper mill 30 facilitates reduction of bending stresses in bottom hole assembly 20, especially between window mill 22 and first upper mill 30. The appreciable distance between second upper mill 40 and third upper mill 46 facilitate reduction of bending stresses between second upper mill 40 and third upper mill 46.

It is to be understood that the invention is not limited to the exact details of construction, operation, exact materials, or embodiments shown and described, as modifications and equivalents will be apparent to one skilled in the art. For example, each mill described herein can be any type of mill or milling device known to persons in the art. Each mill may comprise a separate device secured to the lower and upper joints or they may be formed integral with the lower or upper joints. Each mill may include blades or other cutting devices, or they may include abrasive surfaces. In other words, as used herein, the term "mill" is to be understood to be given its broadest meaning as being any device capable of cutting or reaming casing of a wellbore. Moreover, second and third upper mills may be designed to only ream out the window after it has been cut in the casing by the window mill and the first upper mill. Alternatively, second and/or third upper mill may also cut an upper portion of window 90 above the portion cut by first upper mill 30. Accordingly, the invention is therefore to be limited only by the scope of the appended claims.

What is claimed is:

1. A bottom hole assembly comprising:

a tubular member;

a window mill disposed at a lower end of the tubular member, the window mill comprising a window mill maximum outer diameter;

a first upper mill disposed along the tubular member at a first upper mill distance above the window mill, the first upper mill comprising a first upper mill maximum outer diameter, the first upper mill maximum outer diameter being less than the window mill maximum outer diameter;

a second upper mill disposed along the tubular member at a second upper mill distance above the first upper mill and the window mill; and a third upper mill disposed along the tubular member at a third upper mill distance above the second upper mill, first upper mill, and the window mill, and wherein the first upper mill distance is approximately 20%-37% of the third upper mill distance and second upper mill distance is approximately 55%-75% of the third upper mill distance.

2. The bottom hole assembly of claim 1, wherein the first upper mill maximum outer diameter is less than a maximum outer diameter of the second upper mill, and a maximum outer diameter of the third upper mill.

3. The bottom hole assembly of claim 1, wherein the first upper mill distance is approximately 25% of third upper mill distance.

4. The bottom hole assembly of claim 3, wherein the second upper mill distance is approximately 65% of third upper mill distance.

5. The bottom hole assembly of claim 4, further comprising a whipstock releasably secured to the window mill, the whipstock having a ramp length, wherein the third upper mill distance is approximately 120%-130% of the ramp length of the whipstock.

6. The bottom hole assembly of claim 5, wherein the third upper mill distance is approximately 125% of the ramp length of the whipstock.

7. The bottom hole assembly of claim 5, wherein the whipstock has a whipstock length of at least 21 feet and a ramp length of at least 18.5 feet.

8. The bottom hole assembly of claim 1, wherein the tubular member comprises a lower joint secured to the window mill and comprising the first upper mill, and an upper joint secured to the lower joint and comprising the second upper mill and the third upper mill.

9. The bottom hole assembly of claim 1, further comprising a whipstock releasably secured to the window mill, the whipstock having a ramp length.

10. The bottom hole assembly of claim 9, wherein the third upper mill distance is approximately 120%-130% of the ramp length of the whipstock.

11. The bottom hole assembly of claim 10, wherein the first upper mill is disposed on an under-gauged portion of the tubular.

12. The bottom hole assembly of claim 9, wherein the first upper mill distance is approximately 25% of the third upper mill distance, the second upper mill being distance is approximately 65% of the third upper mill distance, and the third upper mill distance is approximately 125% of the ramp length of the whipstock.

13. The bottom hole assembly of claim 12, wherein the first upper mill is disposed on an under-gauged portion of the tubular.

14. The bottom hole assembly of claim 12, wherein the first upper mill is a ball mill, the second upper mill is a ball mill, and the third upper mill is a watermelon mill.

15. The bottom hole assembly of claim 1, wherein the first upper mill is disposed on an under-gauged portion of the tubular.

16. A method of cutting a window in a casing disposed in a wellbore, the method comprising the steps of:

(a) assembling a bottom hole assembly comprising a tubular member, a window mill disposed at a lower end of the tubular member, a first upper mill disposed at a first distance from the window mill, a second upper mill disposed above the first upper mill at a second distance from the window mill, and a third upper mill disposed above the second upper mill at a third distance from the window mill, wherein the window mill comprises a window mill maximum outer diameter and the first upper mill comprises a first upper mill maximum outer diameter, the first upper mill maximum outer diameter being less than the window mill maximum outer diameter;

(b) lowering the bottom hole assembly into a casing disposed in a wellbore;

(c) engaging the window mill with a whipstock disposed within the casing;

(d) rotating and lowering the bottom hole assembly down the casing along the whipstock while cutting the casing with the window mill;

(e) engaging the second upper mill and the third upper mill with the casing causing the second upper mill and the third upper mill to cut the casing and, thereafter, (f) engaging the first upper mill with the casing causing the first upper mill to cut the casing, wherein the first distance is approximately one-fifth to three-eighths of the third distance and the second distance is about fifty-five to seventy-five percent of the third distance.

* * * * *